United States Patent [19]

Maschke

[11] Patent Number: 4,795,912

[45] Date of Patent: Jan. 3, 1989

[54] METHOD AND APPARATUS FOR CORRECTING CHROMATIC ABERRATION IN CHARGED PARTICLE BEAMS

[75] Inventor: Alfred W. Maschke, Torrance, Calif.

[73] Assignee: TRW Inc., Redondo Beach, Calif.

[21] Appl. No.: 15,193

[22] Filed: Feb. 17, 1987

[51] Int. Cl.[4] ..... H01J 3/14; G21K 1/08

[52] U.S. Cl. ..... 250/356 R; 250/396 ML

[58] Field of Search ..... 250/396 R, 396 ML; 313/361.1

[56] References Cited

U.S. PATENT DOCUMENTS

| | | | |
|---|---|---|---|
| 2,418,349 | 4/1947 | Hillier et al. | 250/396 ML |
| 2,919,381 | 12/1959 | Glaser . | |
| 3,453,485 | 7/1969 | Herrmann et al. . | |
| 3,644,733 | 2/1972 | Wolff et al. . | |
| 4,101,813 | 7/1978 | Parker et al. | 250/396 R |
| 4,335,309 | 6/1982 | Anger | 250/396 R |
| 4,362,945 | 12/1982 | Riecke | 250/396 R |
| 4,431,915 | 2/1984 | Nakagawa et al. | 250/310 |
| 4,450,357 | 5/1984 | Tsuno | 250/396 ML |
| 4,475,044 | 10/1984 | Kuroda et al. | 250/396 ML |
| 4,684,808 | 8/1987 | Plies et al. | 250/396 ML |
| 4,687,936 | 8/1987 | McIntyre | 250/396 ML |

*Primary Examiner*—Bruce C. Anderson

*Attorney, Agent, or Firm*—Noel F. Heal; Sol L. Goldstein

[57] ABSTRACT

A technique for compensating for chromatic aberration in particle beams, caused by differing particle energy levels when a beam is deflected for beam steering or beam focusing. A compensating deflection is applied to the beam upstream of its intended point of deflection. When the particles reach the point of deflection, the effect of the compensating deflection is proportional to the energy level of each particle, and compensates for the aberration that would normally occur. The point at which the compensating deflection is applied is selected to be one-fourth of a cycle in longitudinal phase space and an integral number of half-cycles in transverse phase space. With this critical spacing, the compensating deflection at the point of its application is proportional to relative phase in longitudinal phase space, but is proportional to energy level at the intended point of deflection.

7 Claims, 1 Drawing Sheet

METHOD AND APPARATUS FOR CORRECTING CHROMATIC ABERRATION IN CHARGED PARTICLE BEAMS

BACKGROUND OF THE INVENTION

This invention relates generally to the correction of aberration in charged particle beams and, more particularly, to the correction of chromatic aberration in charged particle beams. The term chromatic aberration is used in particle beam physics to describe phenomena relating to beam particles of different energies. When charged particle beams are focused or deflected using magnetic or electric fields, the effect of a focusing or deflection field on the particles is dependent on the energy of the individual particles.

In many applications of particle beams, there is a requirement for beam steering over a wide range of angles, as well as for focusing the beam. Because of the energy spread of the beam, deflection through any significant angle causes beam dispersion. This distortion of the intended beam divergence is referred to as chromatic aberration. It is analogous to chromatic aberration in optical systems, which is caused when light of different wavelengths is refracted through different angles because the transmission medium, typically a lens, exhibits different indices of refraction at different wavelengths. Chromatic aberration in lenses can be corrected to some degree by forming composite lens systems of different materials. This approach has no direct analogy in particle beam physics. In the past, the correction of chromatic aberration in particle beams has relied on fairly complex arrangements of electric and magnetic fields, but no practical solution to the problem has been found, especially for high-energy beams.

It will be appreciated from the foregoing that there is still a significant need for a technique for correcting chromatic aberration in charged particle deflection systems. The present invention satisfies this need.

SUMMARY OF THE INVENTION

The present invention resides in a method and related apparatus for correcting chromatic aberration in charged particle beams. The aberration occurs at a point of deflection of the beam in a selected transverse direction, and results from differences in energy levels of the particles. Such deflection may result from either beam focusing elements, or beam steering elements. The method comprises the steps of determining the location of a point of compensation upstream of the point of deflection, and applying a compensating deflection force to the beam in the selected transverse direction at the point of compensation, such that the compensating force applied to each particle is proportional to its relative phase in longitudinal phase space at the point of compensation, but is proportional to particle energy when the particles reach the point of deflection. The compensation deflection force compensates for the chromatic aberration that arises at the point of deflection.

As will become apparent from the detailed description of the invention, particles in the beam have an inherent longitudinal phase oscillation with respect to a radio-frequency (rf) signal used for particle acceleration. The oscillation is such that particles having the same phase at one location will have the same energy at a location one-fourth of a cycle later in longitudinal phase space. The same particles also oscillate in a transverse sense as they progress along the beam. If a transverse correction is applied to the particles at a selected compensation point, the resultant deflection will manifest itself at each half-cycle in the transverse oscillation.

Because of these considerations, in the method of the invention the point of compensation is spaced upstream of the point of deflection by a distance that exceeds n cycles in longitudinal phase space by one-fourth of a cycle, when n is zero or a positive integer, and is equal to an integral number of half-cycles in transverse phase space.

In one preferred form of the invention, the method also includes the step of applying a compensating deflection force in an orthogonal transverse direction, to compensate for chromatic aberration effects of a desired deflection in the orthogonal transverse direction.

The apparatus of the invention comprises means for applying a compensating deflection force to the beam in the selected transverse direction at a point of compensation upstream of the point of deflection of the beam. Such compensation can be produced by a radio-frequency (rf) guadrupole of dipole structure operating at a harmonic of the linear accelerator frequency. The compensating force applied to each particle is proportional to its relative phase in longitudinal phase space at the point of compensation, but is proportional to particle energy when the particles reach the point of deflection. The compensation deflection force therefore compensates for the chromatic aberration arising at the point of deflection.

It will be appreciated from the foregoing the present invention represents a significant advance in the field of particle beams. In particular, the invention provides a technique for compensating for unwanted chromatic aberration in particle beams, caused by beam deflections for purposes of beam steering or beam focusing. Other aspects and advantages of the invention will become apparent from the following more detailed description, taken together with the accompanying drawings.

DESCRIPTION OF THE PREFERRED EMBODIMENT

Figure 1:
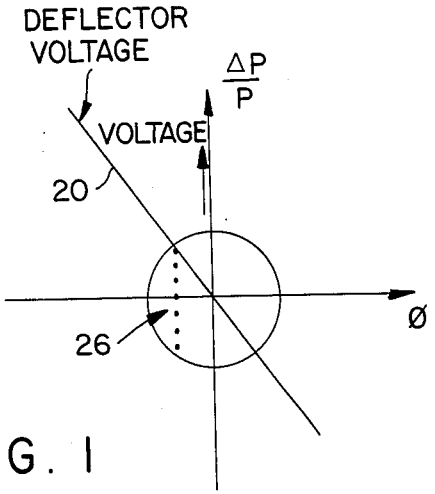
FIG. 1 is a longitudinal phase space diagram for a particle beam, and indicates the energyphase state of particles at a point at which a compensation deflection force is applied to the beam.

As shown in the drawings for purposes of illustration, the present invention is concerned with a technique for correcting for chromatic aberration in a charged particle beam. Before turning to a description of the invention, it is desirable to have a basic understanding of the motion of particles in charged particle beams, and of phase space diagrams as often used to describe this motion.

Particle beams are accelerated by linear accelerators, and one common type of linear accelerator employs radio-frequency (rf) energy to provide an accelerating force at a series of accelerating cells spaced along a longitudinal axis. The spacing of the accelerating cells is selected to provide an additional "kick" to a number of bunched particles as they enter each cell. If a particle reaches the center of a cell exactly in phase with an accelerating signal, the particle is said to be "in phase." However, there is a significant energy distribution among particles, and some particles will arrive too late for the intended energy transfer, while others will arrive too early. If a particle has higher than average energy, it will arrive at the next accelerating cell too early and will accordingly receive a low-energy boost to its velocity, such that at the next following cell it will arrive not quite so early and with a relative phase not quite so far in advance of the average particles. A particle that arrives later than average will receive an accelerating "kick" of greater magnitude than the average or the leading particles, and will tend to arrive at the next following cell with a slightly earlier phase and with slightly more energy than at the previous cell.

This phase-energy relationship of the bunches of particles being accelerated can be conveniently illustrated in the form of a phase space diagram, such as the one shown in FIG. 1. In this diagram, the horizontal axis represents relative phase angle, with the zero point on the axis representing the average or "perfect" particle that proceeds from cell to cell of the accelerator in perfect phase relationship. The vertical axis is used to plot a normalized relative energy level, where the zero point on the axis represents the energy level of the average particle.

Each particle whose energy and phase are represented in this phase space diagram will move in a circular path about the phase space as it progresses along the linear accelerator. For example a phase-lagging lower-energy particle might be represented in the lower-left quadrant of the diagram, but as it receives relatively more energy at each accelerator cell it moves into the upper-left quadrant, still with a lagging phase but with increased energy. Still later, the same particle assumes a leading phase angle and is represented in the upper-right quadrant of the diagram, at which stage it receives relatively less energy from each accelerator cell, and moves gradually into the lower-right quadrant, having less energy than average but still a leading phase. Eventually, the phase angle decreases again through zero and the particle can be represented once more as being in the lower-left quadrant of the diagram.

All particles in the beam move about the phase space in approximately circular paths like the one described. Some particles remain near the "perfect" particles represented at the center of the space, while others undergo larger oscillations of energy and phase. These oscillations occur cyclically along the length of the accelerator, and the figure is referred to as a longitudinal phase space diagram.

Figure 2:
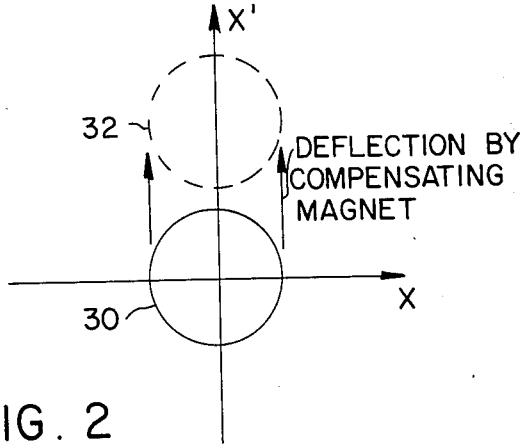
FIG. 2 is a transverse phase space diagram for a particle beam at the point at which the compensation deflection force is applied.

FIG. 2 represents a similar oscillation in a transverse direction, and the figure is referred to as a transverse phase space diagram. The horizontal axis represents displacement in the x-axis transverse direction. By convention, the beam direction is along the z axis and the x and y directions are transverse to the beam direction. The vertical axis in the transverse phase space diagram is $x'$, which represents the rate of change of displacement in the x direction with respect to the z-axis direction. In other words, the quantity $x'$ is equivalent to the angular direction $dx/dz$ of the particle with respect to the central or z axis. When $x'$ is zero, the particle is moving parallel to the beam axis. The quantity $x'$ is also proportional to the instantaneous velocity $dx/dt$ in the x-axis direction. At the origin point of the x and $x'$ axes, the x-axis displacement is zero and the angular direction of the particle with respect to the z axis is zero. This point represents a particle moving along the longitudinal axis of the beam or, more precisely, any particle moving in the y-z plane.

The more general case is that of a particle having a displacement in the x-axis direction and a non-zero angle with respect to the z-axis direction. i.e. a velocity component in the x-axis direction. A particle moving away from the central beam axis in a positive direction is represented in the upper-right quadrant of the diagram. The further the particle moves from the central axis, the more it is decelerated by fields used to focus the particles into the beam. As the same particle reaches its greatest displacement from the central axis, its velocity in the x-axis direction is zero, as is its angular direction with respect to the z axis ($x'=0$), and the particle is now represented in the lower-right quadrant of the diagram. The particle then accelerates to a maximum velocity in the negative sense, back toward the central axis, crosses the central axis ($x=0$), and moves into the lower-left quadrant. Then the particle decelerates again until its velocity in the x-axis direction is zero ($x'=0$), and moves into the upper-left quadrant. Now the particle accelerates positively again and reaches maximum velocity as it crosses the central axis again, to return to the upper-right quadrant. This harmonic oscillation continues as the particle progresses along the beam path. Every particle in the beam may be considered to be following a circular path through the transverse phase space, as indicated by the central circle in FIG. 2.

As already mentioned, chromatic aberration in particle beams manifests itself both in focusing the particles into a beam and in deflecting the beam through a desired angle with minimum dispersion. The technique to be described addresses both of these problems, but is perhaps more easily understood in the context of the beam deflection case.

In an ideal beam in which all of the particles have the same energy, a steering magnetic field would affect all particles equally, including those traveling along the central axis of the beam. Theoretically, the distribution of particles in the transverse phase space would then remain the same after deflection of the beam. In practice, of course, there is an energy distribution among the particles and, for a deflection in the $x'$ direction, some of the particles will have their cyclic paths displaced from the central momentum axis of the beam. This is the essence of the beam dispersion phenomenon for which the invention is intended to provide compensation.

For those particles that are not of average energy, the invention provides a compensating deflection or "kick" equal and opposite to the one that will be later experienced by the particles in the field of the steering magnet. The difficulty, of course, is that particles of different energy levels will be affected differently by the steering forces, and will therefore require different compensating deflections. To achieve this seemingly impossible goal, the invention makes use of the properties of the longitudinal and transverse phase space diagrams, to time the deflection force in such a manner as to be energy dependent.

Two timing conditions are necessary for correct operation of the invention. The first is that the compensating deflection be applied one-fourth of a longitudinal phase space cycle before the steering magnet is reached. Alternatively, the compensating deflection could be applied an integral number of cycles plus one-fourth of a cycle earlier than the steering force. The second necessary condition is that the compensating deflection be applied an integral number of half-cycles of the transverse phase space cycle before the steering force. Whether the net phase difference in the transverse phase space cycle is 0 degrees or 180 degrees affects only the polarity of the compensating force, and the apparatus of the invention may be easily designed to operate either way.

Figure 5:
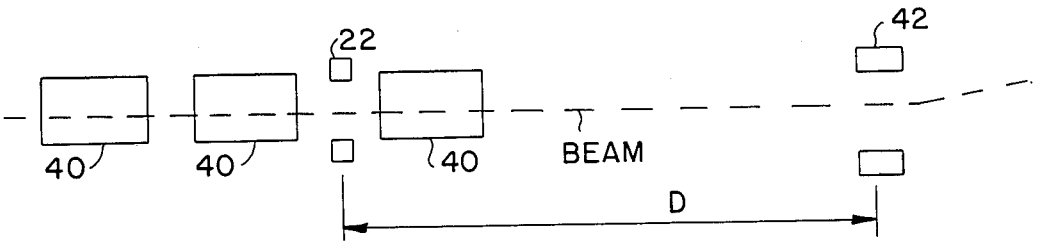
FIG. 5 is a diagrammatic view of the apparatus of the invention.

The significance of the one-quarter cycle spacing is that it permits the compensating deflection to be applied in proportion to particle energy levels. The diagonal line 20 in FIG. 1 represents the deflector voltage applied to the beam by a compensating electric field dipole deflector 22 (FIG. 5). For average energy particles, at zero phase on the diagram, no deflection is applied to the particles. For particles with a lagging phase, i.e. a lagging position in a particle bunch, an increasingly positive deflection force is applied, while for particles with leading phase a deflection of opposite polarity is applied. This deflection voltage is applied at the same rf rate, or a higher harmonic thereof, as the one at which the linear accelerator is operating. For example, a typical linear accelerator operates at 200 MHz (megahertz), and the deflection voltage could be applied 200, 400 or 600 MHz. The magnitude of the compensating deflection voltage is also linearly related to the beam steering force to be applied downstream in the beam. If no steering is to be applied then clearly no compensating deflection is necessary to correct for beam steering chromatic aberration. If the beam is to be steered through large angles, a correspondingly large compensation deflection voltage will be needed.

Figure 3:
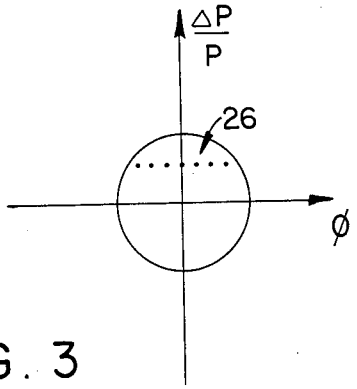
FIG. 3 is a longitudinal phase space diagram similar to FIG. 1, but indicating the energy-phase state of particles at a point of deflection for beam steering purposes.

After the particles have rotated through one quarter-cycle of the longitudinal phase space cycle, particles that had equal phases when the compensation deflection was applied will have equal energy levels. This is shown by the indication of a group of test particles 26, which, in FIG. 1 all have the same phase. In FIG. 3, which represents the same beam at the position of the steering magnet, the same test particles have equal energies or momentum values, since the entire phase space has rotated ninety degrees following the application of the compensating deflection force. The same considerations apply for all particles in the beam. The compensating deflection force applied to the particles in accordance with their relative phase or position makes itself felt at the location of the steering magnet, but in proportion to the energy of the particles.

Figure 4:
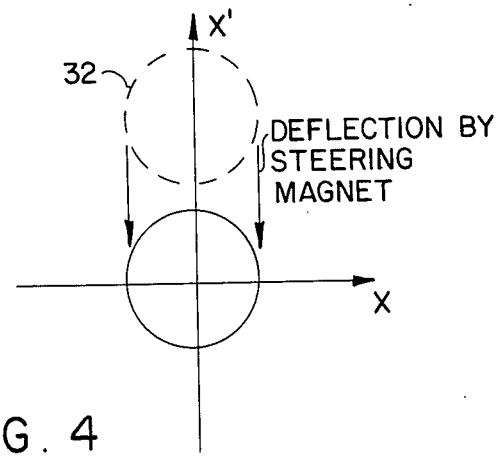
FIG. 4 is a transverse phase state diagram similar to FIG. 2, but indicating the transverse phase space at the point of deflection of the beam.

The effect of this compensation deflection on the transverse phase space is shown in FIGS. 2 and 4. Consider now that the circle 30 in FIG. 2 represents the transverse phase space of the test particles 26 in FIGS. 1 and 3. before deflection by the compensating dipole. After deflection, the same circle has been displaced in the x'-axis direction to the broken-line circle 32. In other words, the angular direction of all of the test particles has been displaced by a fixed amount along the x' axis. In effect, the test particles have been deflected through an angle represented by the distance between the centers of the circles 30 and 32.

One full cycle later (FIG. 4), the circle 32 has made a complete revolution of phase space and is back in the same position as in FIG. 2. This represents the point in time at which the steering magnet deflection force will be applied to the beam. If the compensating deflection force has been properly calculated, the effect of the steering force on the test particles will be to move the circle 32 back to the position of the circle 30 at the center of the phase space. The same considerations apply to test particles of other equal phases in FIG. 1, having equal energy levels in FIG. 3, and giving rise to different displacements in the transverse phase space diagrams of FIGS. 2 and 4. The net result is that the effects of chromatic aberration, caused by the steering of a beam having a spectrum of energy levels, are compensated by the application of a deflection force that affects particles in proportion to their energy levels.

The focusing of a particle beam is also subject to chromatic aberration, which may be corrected by an identical technique to the one described in relation to the beam steering problem. The only difference is that focusing of a beam involves deflection with respect to both transverse axes simultaneously, using one or more quadrupole deflectors. The same compensation principles apply. Compensation deflections are made to the beam one-fourth of a longitudinal phase space cycle before the actual focusing deflections, and an integral number of half-cycles of the transverse phase space cycle. If there are multiple focusing deflectors, there will, in general, need to be an equal number of compensation deflectors appropriately spaced upstream of the focusing deflectors.

As shown in FIG. 5, a typical system will contain multiple linear acceleration modules, three of which are indicated at 40. The compensating dipole 22 (or quadrupole) is located immediately before the last of the acceleration modules 40, and a distance D prior to the final beam steering deflector 42, such that there is one-fourth of a longitudinal phase space oscillation between the compensating dipole 22 and the final linear accelerating module 40. the region between the compensating dipole 22 and the final deflector 42 contains additional focusing elements (not shown), such that there are an integral number of half-cycles of transverse phase space occurring within this region.

It will be appreciated from the foregoing that the present invention represents a significant advance in the field of particle beam physics. In particular, the invention provides a simple technique for compensating for chromatic aberration in the focusing and steering of particle beams. It will also be appreciated that, although an emodiment of the invention has been described in detail for purposes of illustration, various modifications may be made without departing from the spirit and scope of the invention. Accordingly, the invention is not to be limited except as by the appended claims.

I claim:

1. A method for compensating for chromatic aberration in a particle beam, occurring at a point of deflection of the beam in a selected transverse direction, because of energy differences of the particles, the method comprising the steps of:

determining a compensation point spaced upstream of the point of deflection by a distance that exceeds zero or an integral number of longitudinal phase space cycles by one-fourth of a cycle, and is equal to an integral number of half-cycles of the transverse phase space cycle;

applying a compensating deflection force to the beam particles at the compensation point and in the selected transverse direction, such that the deflection force applied to each particle is proportional to its relative phase in longitudinal phase space, and is proportional to the deflection force to be applied to the beam at the point of deflection, whereby, one-fourth of a cycle downstream, with respect to longitudinal phase space, and every full cycle thereafter, the effect of the compensating deflection force will be proportional to particle energy; and applying a desired deflection force at the point of deflection of the beam, whereby the desired deflection force will affect the particles in accordance with their respective energy levels, and the effect of the compensating deflection, which is also proportional to particle energy, will balance the chromatic aberration effect of the desired deflection force.

2. A method as defined in claim 1, and further comprising the steps of:

applying a compensating deflection force in an orthogonal transverse direction, to compensate for chromatic aberration effects of a desired deflection in the orthogonal transverse direction.

3. A method for compensating for chromatic aberration in a particle beam, the aberration occurring at a point of deflection of the beam in a selected transverse direction, as a result of energy differences of the particles, the method comprising the steps of:

determining the location of a point of compensation upstream of the point of deflection; and applying a compensating deflection force to the beam in the selected transverse direction at the point of compensation, such that the compensating force applied to each particle is proportional to its relative phase in longitudinal phase space at the point of compensation, but is proportional to particle energy when the particles reach the point of deflection, whereby the compensation deflection force compensates for the chromatic aberration that would otherwise be present at the point of deflection;

and wherein the point of compensation is spaced upstream of the point of deflection by a distance that exceeds n cycles in longitudinal phase space by onefourth of a cycle, where n is zero or a positive integer, and is equal to an integral number of half-cycles in transverse phase space.

4. A method as defined in claim 3, and further comprising the step of:

applying a compensating deflection force in an orthogonal transverse direction, to compensate for chromatic aberration effects of a desired deflection in the orthogonal transverse direction.

5. Apparatus for compensating for chromatic aberration in a particle beam, the aberration occurring at a point of deflection of the beam in a selected transverse direction, as a result of energy differences of the particles, the apparatus comprising:

means for applying a compensating deflection force to the beam in the selected transverse direction at a point of compensation, such that the compensating force applied to each particle is proportional to its relative phase in longitudinal phase space at the point of compensation, but is proportional to particle energy when the particles reach the point of deflection, whereby the compensation deflection force compensates for the chromatic aberration arising at the point of deflection;

wherein the point of compensation is spaced upstream of the point of deflection by a distance that exceeds n cycles in longitudinal phase space by one-fourth of a cycle, where n is zero or a positive integer, and is equal to an integral number of half-cycles in transverse phase space.

6. Apparatus as defined in claim 5, and further comprising:

means for applying a compensating deflection force in an orthogonal transverse direction.

7. Apparatus for producing a particle beam free of chromatic aberration in all transverse directions, the apparatus comprising:

first deflection means located at a point of deflection, for deflecting the beam in a selected transverse direction for purposes of beam steering or focusing; and second deflection means for compensating for chromatic aberration caused by the first deflection means, the second deflection means providing a compensating deflection force proportional to the amount of deflection applied in the first deflection means, and having an effect at the first deflection means proportional to the energy of each deflected particle;

and wherein the longitudinal spacing between the first and second deflection means exceeds n cycles in longitudinal phase space by one-fourth of a cycle, where n is zero or a positive integer, and is also equal to an integral number of half-cycles in transverse phase space.

* * * * *